United States Patent [19]

Holland

[11] Patent Number: 4,458,701

[45] Date of Patent: Jul. 10, 1984

[54] MASCARA APPLICATOR

[76] Inventor: Linda Holland, 1733 Ysrella Ave., Simi Valley, Calif. 93065

[21] Appl. No.: 476,922

[22] Filed: Mar. 21, 1983

[51] Int. Cl.[3] ..... A45D 40/26

[52] U.S. Cl. ..... 132/88.7; 132/DIG. 3

[58] Field of Search ..... 132/88.5, 88.7; 15/210 A, 160

[56] References Cited

U.S. PATENT DOCUMENTS

| | | | |
|---|---|---|---|
| 741,722 | 10/1903 | Ryder et al. | 15/210 A |
| 946,370 | 1/1910 | Kelmel | 15/160 |
| 1,845,315 | 2/1932 | Meikle | 15/160 |
| 2,323,595 | 7/1943 | Hanisch | 132/88.7 |

FOREIGN PATENT DOCUMENTS

| | | | |
|---|---|---|---|
| 359325 | 1/1906 | France | 15/210 A |

*Primary Examiner*—Gregory E. McNeill

*Attorney, Agent, or Firm*—Paul H. Ware

[57] ABSTRACT

Double brush mascara applicator tongs having a carrying case with a mascara reservoir incorporated therein. The double brush applicator tongs are of one-piece construction and made of resilient material such that the brush members may receive eyelashes therebetween. The natural resilience of the material keeps the brush-holding arms of the tongs apart while not in use. A user need only press the arms together in order to catch the eyelashes between the brushes so as to apply mascara or other make-up material to be applied. Mascara brush-on and eyelash curling may be effected through the novel advantages of the inventive device.

2 Claims, 5 Drawing Figures

MASCARA APPLICATOR

BACKGROUND OF THE INVENTION

1. Field of the Invention

This invention relates generally to devices for the application of facial make up materials and more particularly to the application of mascara to eyelashes and the curling of eyelashes.

2. Description of the Prior Art

Mascara brush applicators are known in which mascara is brushed onto eyelashes and the eyelashes so treated may, in addition, be partially curled by the stroking motion of the applicator brush. While presently available mascara brush applicators can both apply mascara to the eyelashes and curl the eyelashes, some of the disadvantages of these prior art mascara brush applicators include difficulty of use, danger of inadvertently pulling eyelashes out of the eye lid and complication of manufacture thus making the device needlessly expensive. Some prior art mascara applicators comprise many parts thus, parts may be lost or damaged and some are not readily portable. Many different devices have been employed in attempts to solve the problems presented. Most have either presented new problems or only partially solved the problems or both. Most of the applicator devices have therefore served very narrow purposes and have been unreliable in operation with some being even dangerous to the eyes. Many have been expensive to manufacture and fragile so as to present a high rate of device failure.

It would thus be a great advantage to the art to provide a one-piece mascara applicator such that there are no parts to be lost or damaged.

A futher desirable advantage would be the provision of the one-piece mascara applicator in a form that is both safe and easy to use.

A still further beneficial advantage is realized by the operation of the one-piece mascara applicator wherein mascara may be applied to the total eyelash in one operation rather than the conventional method of applying the mascara first to the top surface of the eye lashes and then to the bottom surfaces or vice versa.

Other realizable advantages relate to portability and economy of manufacture.

SUMMARY OF THE INVENTION

The applicator brushes of my invention come together and intermesh so as to cover the entire length of the eyelashes. Thus, in contrast to the conventional, one-brush mascara applicator, one single motion colors, curls and separates the eyelashes thereby saving much time. The conventional one-brush applicator requires many strokes in the application of mascara and, once applied, usually calls for some other instrument such as a straight pin, bobbie pin or toothpick, for example, to be used to separate individual eyelashes which may have received a glob of mascara at application.

It is thus an object of the present invention to provide a one-piece mascara applicator that is quick, easy and safe to use while at the same time being economical to manufacture.

An additional object of the invention is to provide the mascara applicator in a form that effects application of mascara, curling and separation of individual eyelashes to the total eyelash surface in one operation.

An additional object is the provision of the mascara applicator in a form that is easily portable in purse or handbag.

In the accomplishment of these and other objects, tongs comprising a one-piece, double-brush mascara applicator are provided in which the natural resilience of the material of manufacture is utilized to provide positional stability of the arms of the tongs when the device is not in use.

Further advantages and features of the present invention will be more fully apparent to those skilled in the art to which the invention pertains from the ensuing detailed description thereof, regarded in conjunction with the accompanying drawings wherein like reference characters refer to like parts throughout and in which:

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
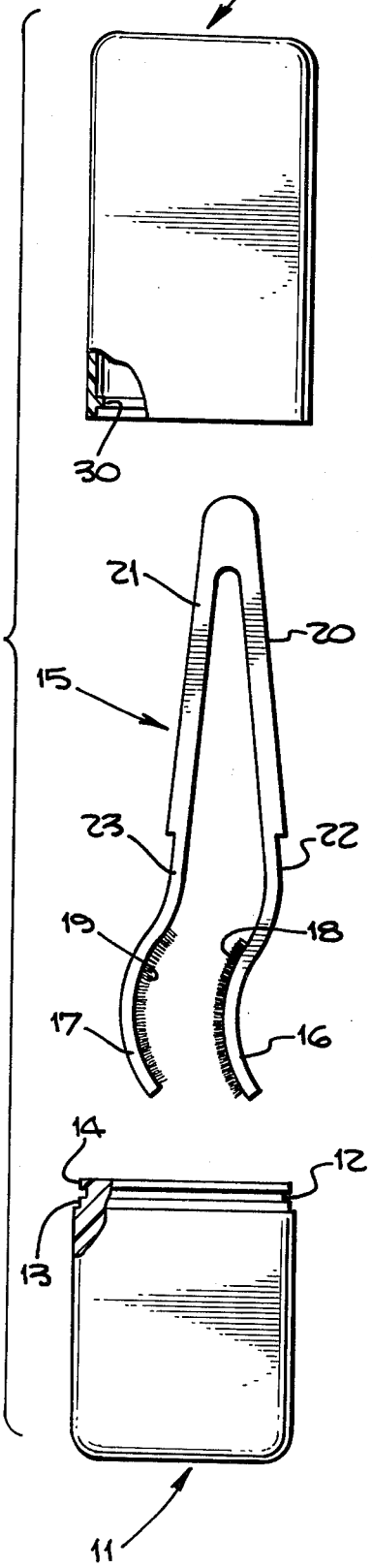
FIG. 1 is a broad-side view of the elements of the device.

Referring to FIG. 1 with greater particularity, there is illustrated a broad-side view of the separate elements of the device. The top of the holder case is denoted by the numeral 10 and, as is apparent, encloses the top portion of the one-piece, double-brush mascara applicator tongs 15 when not in use. The bottom of the holder case, 11, also serves as a repository for mascara. The bottom 11 additionally comprises a channel 12 circumscribing its external boundary as illustrated, said channel 12 being formed between shoulder 13 and top lip 14. The purpose of channel 12 is to secure holder case top 10 to bottom 11 by means of the cooperation of small collar 30 (FIG. 3) with shoulder 13, top lip 14 and channel 12. Such snap locking devices are well known in the art and are merely illustrative of one particular method of case closure that may be used with the inventive device disclosed.

Figure 2:
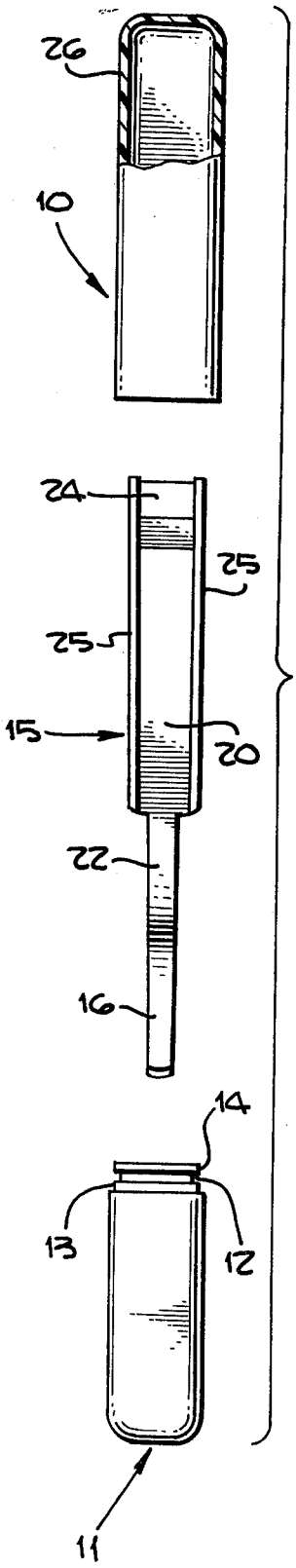
FIG. 2 is a narrow-side view of the elements of the device.
Figure 3:
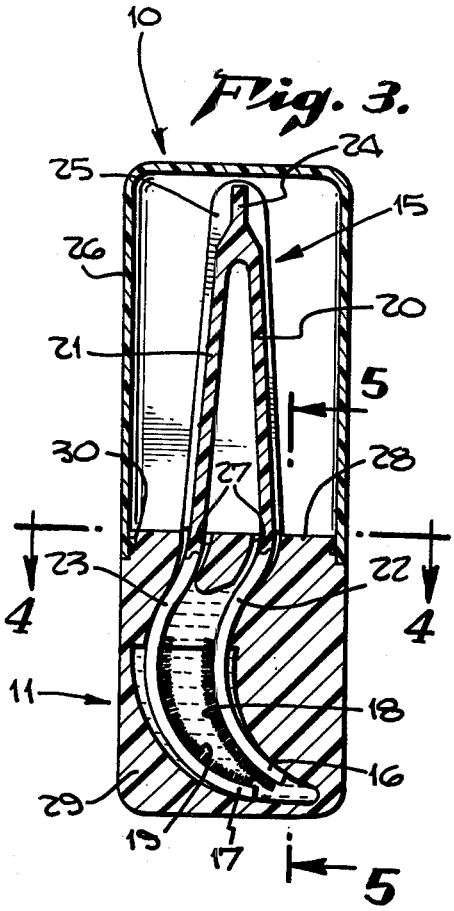
FIG. 3 is a cross section in broadside profile showing the device assembled.

Referring now to FIGS. 1, 2 and 3 and more specifically to the one-piece, double-brush mascara applicator tongs 15, the fabrication and operation of the device may be explained. It is contemplated that the device will be fabricated from a suitable resilient plastic material, however, such contemplation is not intended to limit the material used in fabrication to such plastics. Thus, the mascara applicator could be fashioned from metal or other suitable materials. In the embodiment described, the mascara applicator, shown in the form of a pair of tongs, comprises arcuate, upper brush backing member 16, curved so as to fit easily upon the surfaces of the eyelashes. The member 16 serves as holder for upper brush bristles 18 attached to the convex surface of the member 16. Arcuate lower brush backing member 17, also curved so as to fit easily upon the surfaces of the eyelashes, serves as holder for lower brush bristles 19. The concave surface of member 17 is adapted to receive the convex surface of member 16 so that member 17 may be said to be concavely complimentary to member 16. As is readily apparent, the arcuate members 16 and 17 along with their associated brush bristles, serve as mascara applicators when the tong-like mascara applicator has its upper arm 20 and lower arm 21 squeezed together by the user thereof. The arms of the applicator have thinner portions identified as upper arm thinner portion 22 and lower arm thinner portion 23. These thinner portions allow for greater flexibility than the portions of the arms defined by the numerals 20 and 21 and thus permit flexing of the arcuate surfaces 16 and 17 in making a more nearly perfect fit upon the eyelashes of a user. Thus the bristles of member 16 intermeshingly engage with those of member 17 when the arms of the applicator tongs are squeezed together.

A thickened portion defining a resilient fulcrum of the tong-like device is denoted by the numeral 24. Thus when, for example, the applicator is held by the arms 20 and 21 between the thumb and fingers of one hand and squeezed, the thickened portion 24 provides resistance to exerted pressure and provides for elastic return to the unstressed position illustrated in FIG. 1. Structural stiffening ridges 25 (FIG. 2) may be provided to effect added stiffness of arms 20 and 21.

It is of course necessary that the case comprising the top 10 and bottom 11 is hollow. FIG. 2 illustrates the side walls 26 of the case in fragmented cross section.

Figure 4:
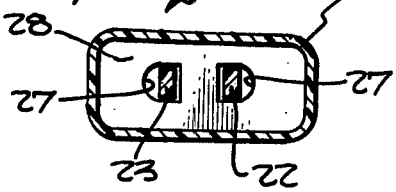
FIG. 4 is a partial cross section taken along the sight lines 4—4 of FIG. 3.

FIG. 3 shows the applicator within the closed case in cross section. The numeral 29 denotes a makeup material reservoir in the bottom case 11 for material to be applied such as mascara. The partial cross section along sight lines 4—4, FIG. 4, show a partial cross section of the upper and lower arm thinner portions 22 and 23 within the D-shaped bottom case brush insertion apertures 27 located in the bottom case cover 28.

Figure 5:
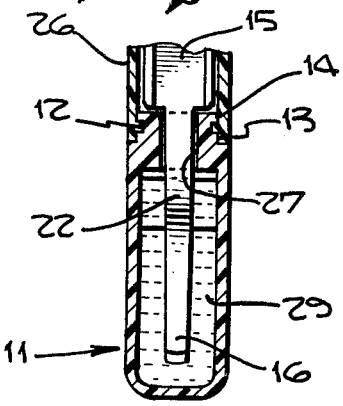
FIG. 5 is a partial cross section taken along the sight lines 5—5 of FIG. 3.

FIG. 5, a partial cross section taken along sight lines 5—5 of FIG. 3, shows the arcuate brush holding surface 16 as situated within the reservoir 29 from a different perspective.

In order to use the applicator, top of holder case 10 is first removed and then the applicator itself is withdrawn from mascara reservoir 29. Excess mascara will be removed from bristles 18 and 19 by their movement of withdrawal through the D-shaped apertures 27. The applicator, grasped between thumb and fingers of one hand, may then have its brushes applied to an upper or lower eyelash as desired by situating the eyelash surface therebetween and squeezing the arms 20 and 21 together so as to brushingly grasp the eyelashes. An outward brushing motion will now serve to apply mascara to the eyelashes and also to impart a curl thereto. Mascara will be applied to both upper and lower eyelash surfaces by means of the cooperation of the upper and lower brush bristles 18 and 19 respectively.

Thus, there has been described a one-piece, double-brush mascara applicator that will greatly enhance the application of eye make up. Great improvements in time saving, portability, reliability, ease of operation, safety, and economy have been provided through the novel advantages of the invention.

It is pointed out that although the present invention has been shown and described with reference to particular embodiment, nevertheless various changes and modifications, obvious to one skilled in the art to which the invention pertains, are deemed to lie within the purview of the invention.

What is claimed and desired to be secured by Letters Patent of the United States is:

1. In combination a double mascara brush and holder comprising:

a top of holder case;

a bottom of holder case adapted to receive said top of holder case in snap-locking fashion;

a makeup material reservoir in said bottom of holder case having a bottom case cover, said cover having two D-shaped brush insertion apartures therein;

double brush, mascara applicator tongs adapted to be received into said bottom of holder case and snap locked therein by said top of holder case, said tongs comprising:

an upper arm, one end of which terminates in an arcuate upper brush backing member;

brush bristles attached to the convex surface of said arcuate upper brush backing member;

a lower arm, one end of which terminates in an arcuate lower brush backing member concavely complimentary to said arcuate upper brush backing member;

brush bristles attached to the concavely complimentary surface of said arcuate lower brush backing member;

a resilient fulcrum joining the other ends of said upper arm and said lower arm together so that said brush bristles attached to the convex surface of said arcuate upper brush backing member and said brush bristles attached to the concavely complimentary surface of said arcuate lower brush backing member are in facing relationship to each other;

so that when said upper arm and said lower arm are squeezed together against the resilient force of said fulcrum, said brush bristles attached to the convex surface of said arcuate upper brush backing member intermeshingly engage the brush bristles attached to the concavely complimentary surface of said arcuate lower brush backing member.

2. The device of claim 1 wherein said top of holder case has a snap collar and said bottom of holder case has a channel situated between a top lip and a shoulder, said channel being adapted to receive said snap collar in snap-locking fashion.

* * * * *